US009441449B1

(12) United States Patent
Abi Aad

(10) Patent No.: US 9,441,449 B1
(45) Date of Patent: Sep. 13, 2016

(54) SWELLABLE PACKER

(71) Applicant: Elie Robert Abi Aad, Jounieh (LB)

(72) Inventor: Elie Robert Abi Aad, Jounieh (LB)

( * ) Notice: Subject to any disclaimer, the term of this patent is extended or adjusted under 35 U.S.C. 154(b) by 66 days.

(21) Appl. No.: 14/713,092

(22) Filed: May 15, 2015

Related U.S. Application Data

(60) Provisional application No. 61/953,925, filed on Mar. 16, 2014.

(51) Int. Cl.
*E21B 23/06* (2006.01)
*E21B 33/127* (2006.01)

(52) U.S. Cl.
CPC ..... *E21B 33/127* (2013.01)

(58) Field of Classification Search
USPC ..... 166/188, 387, 101, 106, 114
See application file for complete search history.

(56) References Cited

U.S. PATENT DOCUMENTS

| | | | | |
|---|---|---|---|---|
| 8,074,723 | B2 | 12/2011 | Nutley et al. | |
| 8,397,802 | B2 | 3/2013 | Lembcke | |
| 8,561,689 | B2 | 10/2013 | Nutley et al. | |
| 8,627,894 | B2 | 1/2014 | Nutley et al. | |
| 2003/0201613 | A1* | 10/2003 | Matczak et al. | 277/602 |
| 2008/0110626 | A1* | 5/2008 | Allison et al. | 166/288 |
| 2008/0185158 | A1* | 8/2008 | Chalker et al. | 166/387 |
| 2010/0243269 | A1* | 9/2010 | Solhaug et al. | 166/374 |
| 2011/0005779 | A1 | 1/2011 | Lembcke | |

* cited by examiner

*Primary Examiner* — Cathleen Hutchins
*Assistant Examiner* — Ronald Runyan
(74) *Attorney, Agent, or Firm* — Harrison Law Office, P.C.

(57) ABSTRACT

A swellable packer enabling wellbore isolation in both open hole and cased hole wells. Longitudinal embodiments and radial embodiments have a plurality of channels that penetrate the elastomeric member and through which hydrocarbon and aqueous fluid flow. The plurality of channels enable extensive distribution of this activating fluid and facilitate maximum swelling of the elastomeric member.

17 Claims, 6 Drawing Sheets

SWELLABLE PACKER

RELATED APPLICATIONS

This application claims priority based upon U.S. Provisional Application Ser. No. 61/953,925 filed Mar. 16, 2014.

FIELD OF THE INVENTION

The present invention relates to downhole production of hydrocarbons, and more particularly relates to swellable production packers capable of becoming extremely expanded for enabling wellbore isolation for production of hydrocarbons and for facilitating completions in multi-zone downhole operations.

BACKGROUND

There has been significant growth and developments in domestic applications of fracking during well completion operations. Special downwell equipment and downhole tools have been introduced to support and promote multi-zone production and during fracking operations, but a problem that has persisted is having the capability to successfully isolate multiple production zones using appropriate packers but without inhibiting normal fluid flow downhole. For example, industry standard swellable packers have limited capability for achieving expansion of an implicated rubber element without unduly increasing swellable packer outside diameter. It would be particularly advantageous in the downhole art to provide swellable packers that effectuate prerequisite expansion to sufficiently isolate production zones to prevent hydrocarbons flow from one zone or stage to another.

Regardless of whether particular zones are producing or not, it is well known to be counterproductive for hydrocarbons to flow downhole or uphole from one zone into another, rather than to just flow uphole or even downhole. It will be understood by those skilled in the art that such zones or stages are purposefully separated from each other by properly emplacing packers or via such control tools as an inflow control devices to avoid interference with intended flow of hydrocarbons. That is, as is well known in the downhole art, there should be no communication between different zones.

Accordingly, what is needed is a production swellable packer that precludes interference from different hydrocarbon producing zones, on the basis of inherently having a smaller outer diameter than swellable production packers known in the art. It will be appreciated that such smaller diameter production packer prevents occurrence of damage thereto while being moved into place downhole. For instance, prior art swellable packers tend to become stuck to virtually any of a plethora of wellbore obstructions which is especially troublesome under circumstances in which well clearance could be tight between the packer's outside diameter and the adjacent wellbore wall.

As will be elucidated hereinafter, once an embodiment of the instant swellable production packer is installed downhole typically avoiding well wall contact because of its significantly smaller outside diameter and simultaneously having minimized the chance of getting stuck while being emplaced and set within the wellbore, the rubber element swells to a greater extent than has heretofore been achieved in the art, and thereby precludes and blocks any uphole flow of hydrocarbons from a lower reservoir uphole and subsequently into an upper reservoir. Instead, flow of hydrocarbons proceeds within the swellable packer tool, not within the annulus between the tool and the wellbore. It will be appreciated by those skilled in the art that embodiments of the present swellable packer invention will nonetheless be experiencing swelling while being emplaced downhole because continuous contact with upwardly-flowing hydrocarbons activates rubber swelling. Hence, it will be seen that embodiments of the present invention fulfill a crucial production packer prerequisite by facilitating proper placement downhole and then, once being properly emplaced, precluding interference between production zones. That is, unlike swellable packers common in the art, embodiments hereof would be unlikely to be prematurely set downhole, thereby avoiding the necessity of fishing out the tool and possibly consequently causing damage thereto and, indeed, to other nearby tools that have been emplaced downhole.

These and other known deficiencies in the downhole art have continued to limit the functionality of commonly used packer tools. Accordingly, these limitations and disadvantages of the prior art are overcome with the present invention, wherein improved means and techniques are provided which are especially useful for effectively isolating production zones.

SUMMARY

Embodiments of the present swellable packer invention pertain to zonal isolation permanent packers that afford more substantial expansion than has been heretofore known in the art. It will be appreciated by those conversant in the art that swellable packers taught herein enable wellbore isolation in both open hole and cased hole, not only in vertical wells but also in horizontal wells, wherein practitioners can now permanently separate different well production zones and thereby control production logistics in a manner heretofore unattainable.

It will be understood that, since rubber volume can be controlled simultaneously with swell time, rubber volume increases in a proportional relationship with diffusion of an admixture of hydrocarbons fluids and water into swelling rubber. As will become apparent to those skilled in the art, packer embodiments hereof provide unique functionality heretofore unknown in the downhole art because of three underlying unique alternative embodiments.

One embodiment of the present invention suitable for short seals is characterized herein as a longitudinal design. A second embodiment of the present invention suitable for long seals is characterized as a radial design. A third embodiment of the present invention is characterized as a fortified design, which is contemplated as supplementing either the instant longitudinal design or the instant radial design or contemplated as even constituting a unique and different design. Yet another, fourth embodiment of the present invention is a combination of all three of these embodiments, wherein the fourth embodiment would constitute a synergy of longitudinal channels, radial channels and a fortifying elastomeric net mesh as will be hereinafter described.

As will become evident to those skilled in the art, both longitudinal embodiments and radial embodiments hereof involve a plurality of channels that penetrate the rubber member in order to open channels enabling reacting fluid to reach portions that heretofore have suffered from not being sufficiently swelled as contemplated herein, using prior art protocols. It has been found, on the contrary, that packer embodiments of the present invention tend to swell more extensively and, accordingly, afford more reliable seal performance—even for formerly unreachable portions—crucial in the frac art.

It will be appreciated that embodiments hereof reduce operating costs since cementing is not needed. Swelling taught hereunder is dependent upon the hydrocarbon fluids present downhole and upon temperature attributes, but does not require deploying pressure or a workstring to achieve optimal performance. Furthermore, methodology enabled hereunder is not prone to mechanical, hydraulic or electrical failure as is a common problem in the art.

It should be understood that rubber members disclosed herein correspond to any of several suitable synthetic elastomeric polymeric materials known in the art, that afford high swell coefficient that enables production zones to be effectively isolated as contemplated hereunder. The terms "rubber"; synthetic rubber'; "elastomer"; and "elastomeric material" are used interchangeably herein. Such selected elastomer is cured in a manner well known in the art and then incorporated into embodiments of the present invention.

It will also be seen that the present invention also contemplates embodiments that have been fortified with an elastic net member which structurally sandwiches or bounds the enclosed rubber element.

It is accordingly an object of the present invention to provide a swellable packer that reduces operating costs by precluding the necessity for conventional cementing.

It is another object of the present invention to provide a swellable packer that affords simple deployment.

It is yet another object of the present invention to provide a swellable packer with prerequisite integrity and reliability to preclude vulnerability to either mechanical failure, hydraulic failure, or electrical failure.

It is also an object and advantage of the present invention that embodiments tend to swell with oil, water or an admixture thereof into over-sized or odd-shaped channels, thereby promoting prerequisite seal qualities heretofore unknown in the art.

These and other objects of the present invention will become apparent from the following specifications and accompanying drawings.

DETAILED DESCRIPTION

Figure 1A:
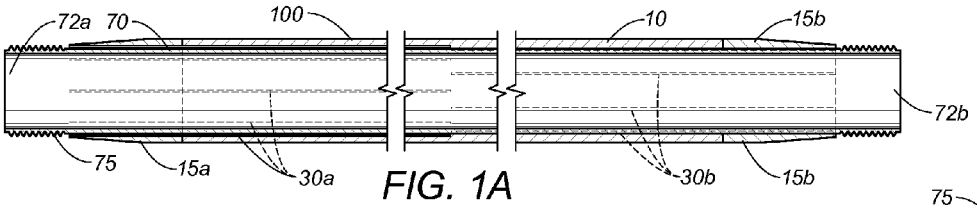
FIG. 1A depicts a frontal cross-sectional cut-away view of a longitudinal swellable packer embodying the present invention.
Figure 1B:
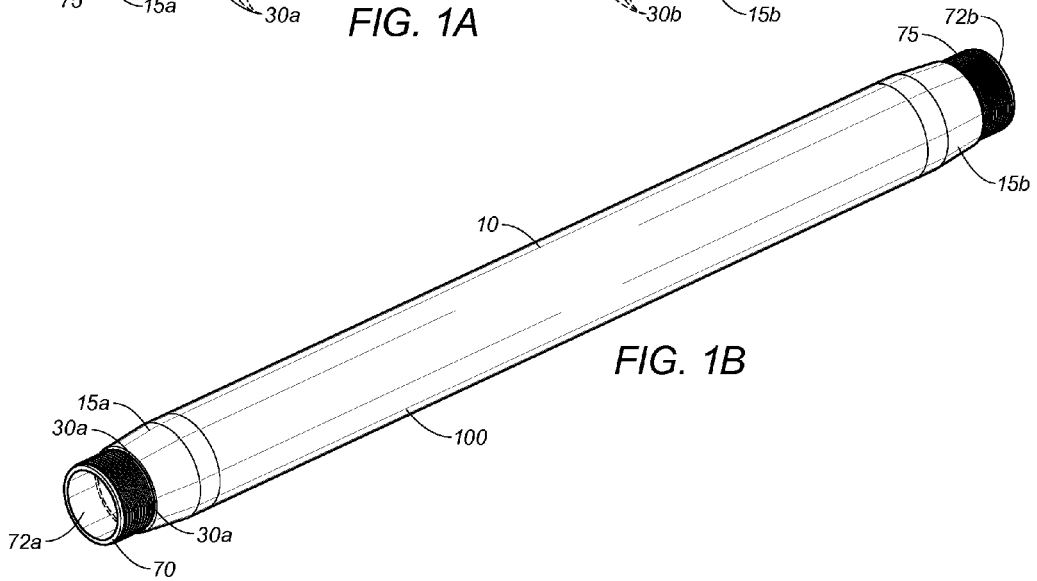
FIG. 1B depicts a frontal perspective view of the longitudinal swellable packer depicted in FIG. 1A.
Figure 2A:
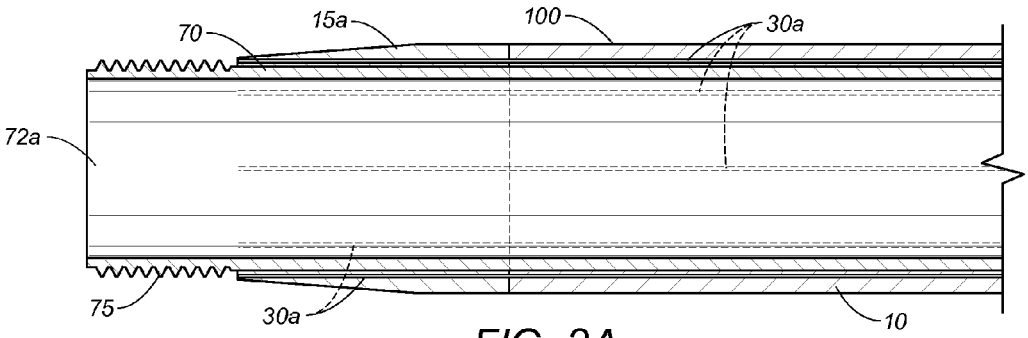
FIG. 2A depicts an enlarged view of the longitudinal swellable packer embodiment depicted in FIG. 1, focusing on a longitudinal hole disposed therein.
Figure 2B:
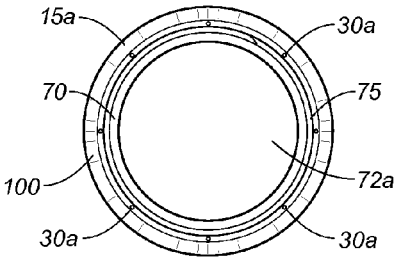
FIG. 2B depicts a first end view of the longitudinal swellable packer embodiment depicted in FIG. 2A.
Figure 2C:
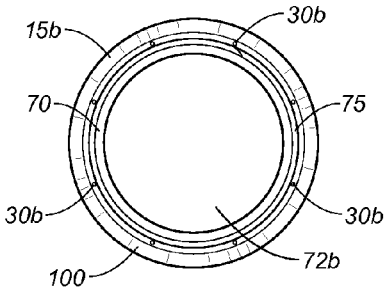
FIG. 2C depicts a second end view of the longitudinal swellable packer embodiment depicted in FIG. 2A, opposite of the end view depicted in FIG. 2B.
Figure 3A:
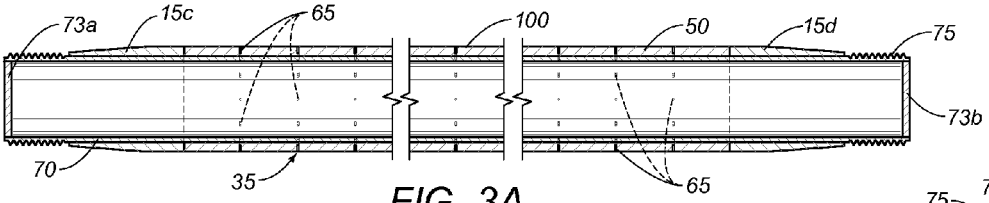
FIG. 3A depicts a frontal cross-sectional cut-away view of a radial swellable packer embodying the present invention.
Figure 3B:
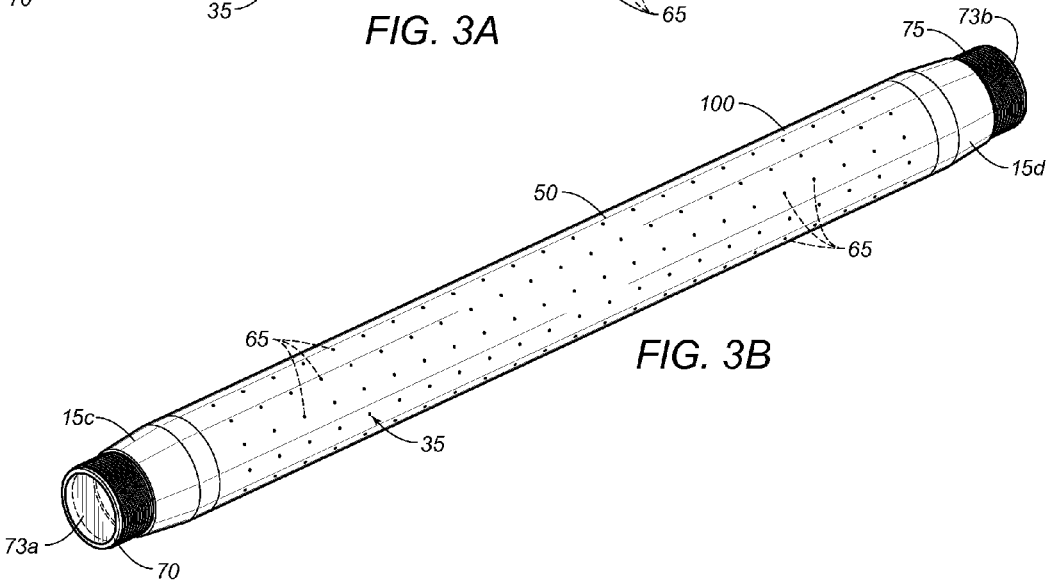
FIG. 3B depicts a frontal perspective view of the radial swellable packer depicted in FIG. 3A.
Figure 4A:
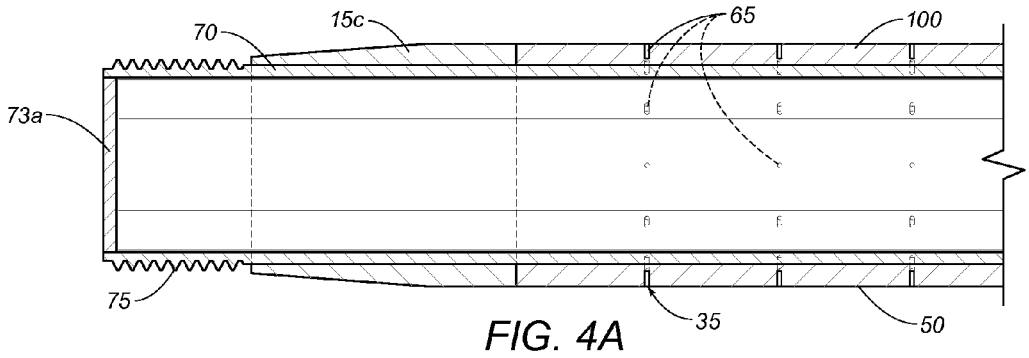
FIG. 4A depicts an enlarged view of the radial swellable packer embodiment depicted in FIGS. 3A-B, focusing on a radial hole disposed therein.
Figure 4B:
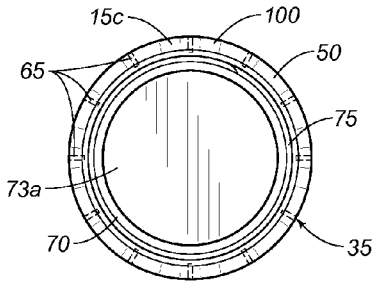
FIG. 4B depicts a right end view of the radial swellable packer embodiment depicted in FIG. 4A.
Figure 5A:
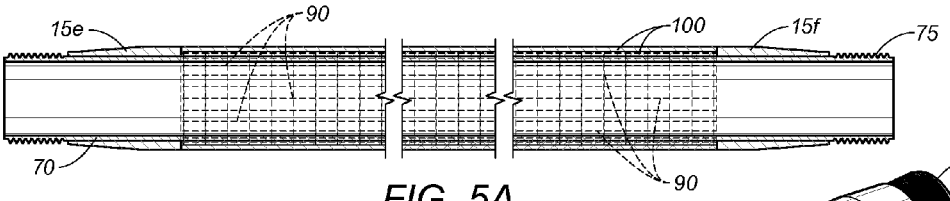
FIG. 5A depicts a frontal cross-sectional cut-away view of a fortified swellable packer embodying the present invention.
Figure 5B:
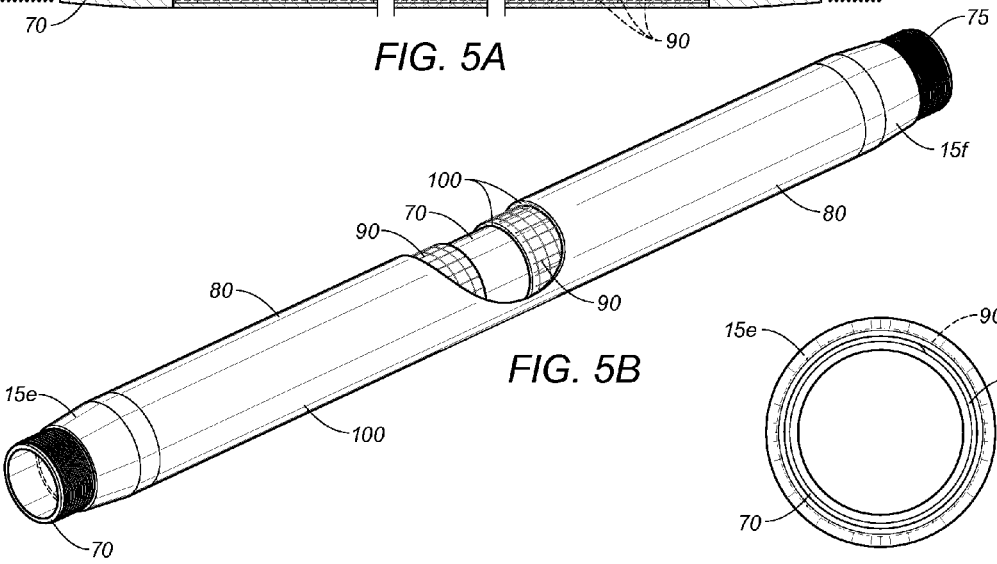
FIG. 5B depicts a frontal perspective view of the fortified swellable packer depicted in FIG. 5A, depicting a cut-away view of a fortifying member thereof.
Figure 5C:
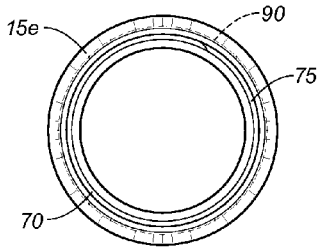
FIG. 5C depicts an end view of the fortified swellable packer depicted in FIGS. 5A-B.
Figure 6:
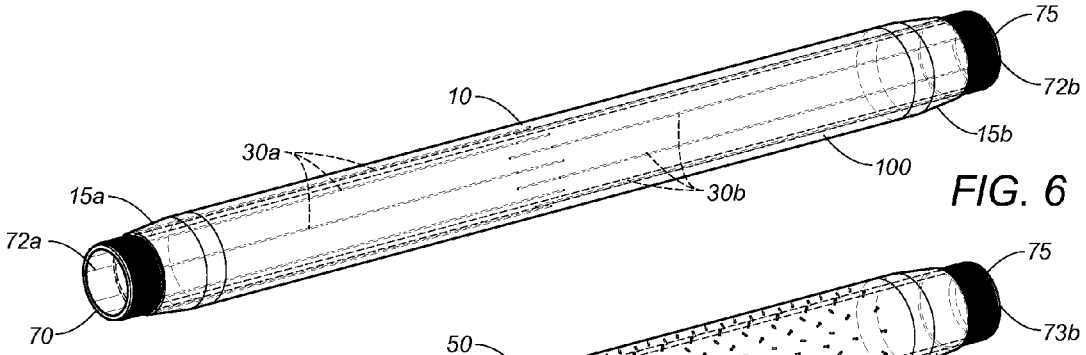
FIG. 6 depicts a transparent perspective view of the longitudinal swellable packer embodiment depicted in FIGS. 1A-B and 2A-C.

Reference is made herein to the figures in the accompanying drawings in which like numerals refer to like components. Now referring collectively to FIGS. 1-8, there are depicted three embodiments of the present invention corresponding to swellable packers as will be hereinafter described. More particularly, FIGS. 1A-B, 2A-C, and 6 depict a longitudinal swellable packer embodiment hereof. Similarly, FIGS. 3A-B, 4A-B, and 7 depict a radial swellable packer embodiment hereof. FIGS. 5A-C, and 8 depict a fortified swellable packer embodiment hereof.

Focusing on FIGS. 1A-B and 2A-C, there are depicted perspective and isolated cross-sectional views of a preferred embodiment of the longitudinal swellable packer 10 taught by the present invention that would be emplaced downhole in the production string during hydrocarbon recovery and fracking operations. This preferred embodiment comprises an apparatus that circumscribes or encompasses mandrel 70 or like cylindrical downhole member, including customer-specified thread 75, pair of end preferably metal rings 15*a-b* for retaining rubber element 100 bonded to mandrel 70, and pair of longitudinal channels or passageways 30*a-b* that enable hydrocarbon fluids and/or aqueous fluid to flow longitudinally and linearly into the rubber-coated mandrel via each opposite end thereof 72*a-b*, but, importantly, not therethrough. It will be appreciated that first plurality of longitudinal channels 30*a* start at a first end of packer embodiment 10 and second plurality of longitudinal channels 30*b* start at a second, opposite end thereof, both channel pluralities being disposed just below the surface of rubber element 100 and traversing from a respective end portion to the middle portion thereof. That is, as will be appreciated by those skilled in the art, each plurality of longitudinal passageways 30*a* and 30*b* is not aligned with the other so that there is no communication therebetween. As shown in the end views illustrated in FIGS. 2B and 2C, respectively, first plurality of longitudinal passageways 30*a* and second plurality of longitudinal passageways 30*b* are offset preferably by about 22½°.

Those skilled in the art will appreciate that embodiments of swellable packers taught hereunder may be affixed to any of several circular pipes, ring or slip structures, or downhole tools that are in situ and require isolation as contemplated hereunder. For illustrative purposes only and not intended to limit the applicability of embodiments hereof, description of swellable embodiments herein and accompanying drawing figures are elucidated in the context of a mandrel.

It has been found that embodiments hereof may achieve the contemplated functionality elucidated hereunder at other offsets encompassing the 22½° optimum. Thus, a preferred range of offsets would be from 5° to 40°; a more preferred range of offsets would be from 15° to 35°; and a more preferred range of offsets would be from 20° to 25° offset. Those skilled in the art should appreciate that if such offsets are smaller than about 5° there is a significant likelihood of interference between neighboring channels.

This arrangement, of course, facilitates ultimate entry of hydrocarbon liquid into the rubber element's pores thereby causing swelling of packer 10. It is contemplated hereunder that longitudinal swellable embodiment 10 elucidated herein would be suitable for sealing pipe in the range 1-12 feet long. It should be evident that for lengths greater than 10-12 feet drilling substantially parallel longitudinal passageways within elastomeric material contemplated hereunder is a manufacturing challenge and, indeed, would essentially be impracticable. It will be appreciated that the appropriate number of longitudinal passageways incorporated into embodiments hereof would be functionally related to the like number of longitudinal channels commensurate size of the instant downhole tool, e.g., 4, 6, 8, 10, 12 or even 16 channels. It has been found that the size of the channels should be the same but the number of channels should preferably be proportional to the tool size.

As clearly shown in FIG. 1A, FIGS. 2A-C, and FIG. 6 the longitudinal channels of the packer depicted therein swell radially to effectuate the extraordinary sealing contemplated hereunder. It will be understood the pair of metal ring or end ring members 15*a-b* delineate each end of longitudinal swellable packer 10 and contain pressure build-up and restrict linear axial expansion of the elastomeric member, thereby confining expansion or swelling to radial movement. Practitioners in the art will readily appreciate that it has been found to be advantageous to effectuate a rough surface of the mandrel via sand blasting, or like procedure known in the art, prior to bonding the elastomeric element thereto with a suitable bonding agent well known in the art, and then the assembly being conventionally cured in an autoclave. It should be clearly understood that the elastomeric element contemplated hereunder should not comprise natural rubber, but, instead, should comprise synthetic rubber which will be susceptible to irreversibly swelling as herein elucidated. The synthetic rubber element should be selected on the basis of being sufficiently oleophilic to expand upon being exposed to at least one activating hydrocarbon and/or being sufficiently hydrophillic to expand upon being exposed to at least one activating aqueous fluid. It is contemplated that there are many suitable synthetic elastomeric materials that may be selected to comprise the rubber element hereunder which affords a high swell coefficient sufficient to isolate production zones as taught herein. As an example, ethylene propylene diene monomer has been found to afford adequate swelling properties to effectuate prerequisite production zone isolation performance.

It will also be appreciated that containing liquid hydrocarbon fluid and the like within the pair of offset or purposefully misaligned longitudinal channels 30*a-b* within rubber element 100 causes swelling beyond the conventional upper ⅔ of the rubber-enclosed mandrel, thereby tending to close the pores because the swelling would already be effectuated by the time liquid hydrocarbons or the like travel to the interior ⅓ thereof. It should be apparent that the extent and effectiveness of the radial swelling enabled by embodiments of the present invention far exceed the downhole swellable packer sealing attributes known in the art. Pair of preferably metal end ring members 15*a-b* should also be configured with concentric channels therein in order to promote hydrocarbon fluid entry therethrough and into the longitudinal channels contemplated hereunder. As an example, it has been found that plurality of channels having fixed most preferred diameter of about 0.078 inches and uniformly distributed radially about the mandrel achieve the prerequisite functionality taught herein. Of course, other suitably sized diameters may also suffice in packer embodiments hereof. For instance, it has been found that channels having a fixed diameter in the range 0.06 inches to 0.16 inches would be preferred for embodiments hereof. Also, by way of example, it has been found that an offset of about 22½° achieve the longitudinal channel misalignment necessary to prevent fluid communication between first plurality of longitudinal channels 30*a* and second plurality of longitudinal channels 30*b*, wherein hydrocarbon fluid is retained therein.

FIGS. 3A-B, FIGS. 4A-B, and FIG. 7 depict perspective and isolated cross-sectional views of a preferred embodiment of the radial swellable packer 50 taught by the present invention. This preferred embodiment comprises mandrel 70, customer-specified thread 75, end ring pair 15*c-d*, and plurality of channels 35 with each channel member 65 penetrating radially into rubber element 100 coating mandrel 70 throughout its length. It should be understood that each such radial channel or passageway extends from the outer surface of elastomeric element 100 therethrough to the interior interface between the elastomeric member and the cylindrical mandrel on the opposite lateral end thereof, where each channel or passageway terminates. This radial swellable packer embodiment is contemplated to be suitable for sealing pipe longer than 12 feet long. It will be appreciated by those skilled in the art that the radial swellable packer taught hereunder enables swelling of rubber element 100 to occur on rubber-coated outer surface of mandrel 70 where such swelling typically has heretofore failed to occur. It will be appreciated that pair of end rings 15*c-d* of this radial implementation of the present invention depicted at respective opposite ends 73*a-b* thereof in FIGS. 3A-B and with end ring 15*c* depicted at end 73*a* in FIGS. 4A-B, unlike the longitudinal implementation hereof depicted in FIGS. 1A-B and FIGS. 2A-B, contains no surface holes and no corresponding internal channels. This, of course, is based upon hydrocarbon fluid and the like entering the plurality of channels 35 radially rather than from either longitudinal end thereof.

Figure 7:
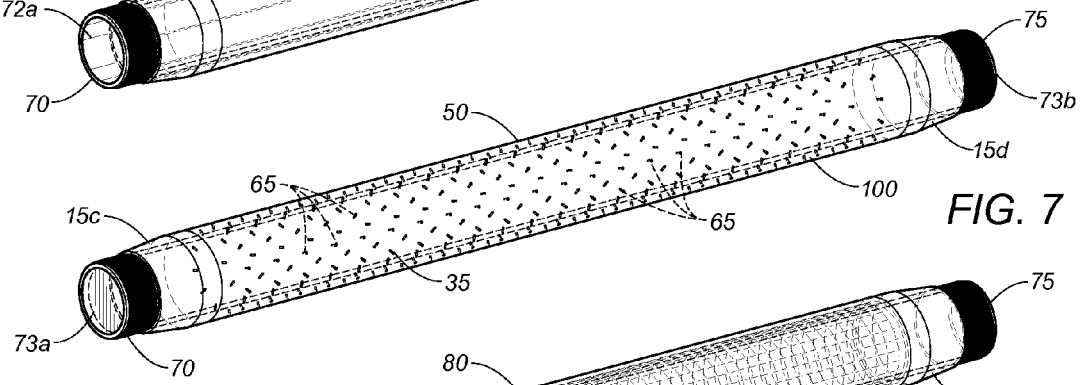
FIG. 7 depicts a transparent perspective view of the radial swellable packer embodiment depicted in FIGS. 3A-B and 4A-B.
Figure 8:
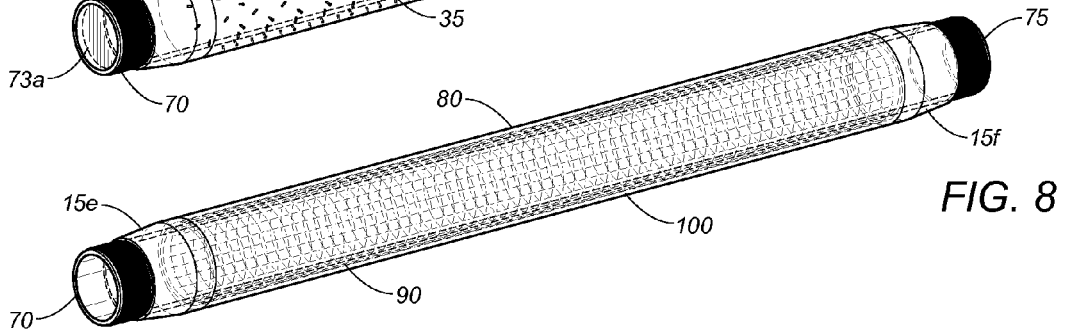
FIG. 8 depicts a transparent perspective view of the fortified swellable packer embodiment depicted in FIGS. 5A-C.

By creating radial channels upon this circumferential surface throughout relatively long lengths of rubber-coated pipe, this radial packer embodiment enables hydrocarbons fluids and/or water to penetrate where the cured rubber was heretofore unreachable, thereby effectuating swelling far beyond what has been attainable and, consequently, manifesting swellable packers having astonishingly strong and enduring seals. FIG. 7 depicts a transparent perspective view of plurality of radial channels that have been found to be especially effective for effectuating substantial swelling to portions thereof being virtually ⅔ depth of the rubber-coating 100 bonded to mandrel 70 which has been heretofore unattainable in the downhole art. As an example, it has been found that plurality of channels having fixed diameter of about 0.098 inches and uniformly distributed longitudinally along the mandrel achieve the prerequisite functionality taught herein. Of course, channels having other suitably sized diameters as well as having variable and non-uniform diameters may also suffice in packer embodiments hereof. For instance, it has been found that channels having a fixed diameter in the range 0.08 inches to 0.20 inches would be preferred for embodiments hereof. Thus, radial and/or longitudinal packer embodiments contemplated hereunder might be configured with channels of variable sizes, wherein such channels could gradually increase in size while moving from side to side thereof and, for the radial embodiment, toward the packer's middle section. For instance, channels proximal to the sides thereof might be sized 0.08" and then gradually grow approaching 0.20" at mid-length thereof. Those skilled in the art will thus appreciate that such a variable sized, non-uniform swellable packer embodiment may be more suitable for circumstances in which uniform expansion is inappropriate and actually heightened expansion is appropriate at mid-length for a particular customer's downhole scenario.

Those skilled in the art should readily appreciate that both longitudinal and radial swellable packer embodiments hereof teach hydrocarbon fluid penetration into the synthetic rubber element heretofore unattainable. Since prior art swellable packers have been devoid of either a plurality of offset longitudinal channels or a plurality of radial channels, about the inner ⅓ of the depth of the rubber has heretofore been devoid of fluid and hence the extent of swelling was limited. On the contrary, swellable packers taught hereunder enable maximum penetration of the rubber element wherein fluid penetrates the inner ⅓ of the depth of the rubber affixed to the mandrel. Accordingly, the full thickness of the rubber element is being swelled in embodiments of the present invention and proportionately more swelling is manifest. It will also be understood that an added bonus inherent in the radial swellable packer embodiment is that the myriad surfaces interspersed between and circumscribing the plethora of radial channels tends to maximize penetration of activating fluid within the rubber element. Hence, similar to the design of the longitudinal swellable packer taught hereunder, the radial swellable packer also inherently maximizes penetration of activating fluid into the rubber element, thereby maximizing swelling thereof.

It will be appreciated by those conversant in the art that the extraordinary swelling manifest by embodiments hereof are especially effective obtaining wellbore isolation and effectuating full and complete seals as contemplated hereunder even under circumstances in which odd-shaped wellbores are prevalent. Of course, such oddly shaped wellbores are not uncommon particularly in the context of openhole drilled wells which typically manifest oval shapes rather than circular shapes. It will also be understood that the plurality of longitudinal channels and plethora of radial channels taught hereunder may be characterized by various cross-sectional shapes including not only circular, but also triangular, square, helical, threaded.

Now referring to FIGS. 5A-C and FIG. 8 there is depicted frontal perspective views of a preferred embodiment of the fortified swellable packer 80 taught by the present invention. This embodiment is emplaced upon a cylindrical downhole member such as mandrel 70, customer-specified thread 75, net member or webbing member 90 sandwiched or interspersed between layers of cured elastomeric members or cured elastomeric elements 100. It will be understood that this webbing member tends to reinforce intertwined rubber layers 100 which is especially advantageous under conditions of extreme expansion whereupon the rubber may otherwise fail to seal. As can be appreciated by those skilled in the art, webbing members 90 are associated with a particular size mesh contemplated hereunder to preferably afford sufficiently elastic characteristics, e.g., nylon and latex materials, Kevlar, and even natural rubber, to withstand tensile forces manifest by conditions of high expansion.

This sandwich configuration should preferably constitute a tightly wrapped structure to assure the longevity thereof during and after curing has been effectuated in an autoclave or the like. Then, during curing, essentially a closed rubber-coated container has been created with webbing member uniformly distributed. It has been found that such fortified swellable packer embodiments enable the underlying properties thereof to be locked in place whereupon no further changes thereto occur. Indeed, it has been found that webbing-fortified embodiments hereof enable all voids in the rubber-coated mandrel to be penetrated, thereby eliminating such voids therefrom and maximizing swelling thereof.

Fortified swellable packer embodiments may also be configured with multiple webbing member layers having different mesh sizes and even having different stretching attributes. For example, mesh sizes of each webbing layer would be separated from each other by a similar elastomeric layer, devolving to a multi-layered sandwich structure. Such a layered structure can simultaneously achieve optimal rubber bonding and optimal stretching of each layer as a function of distance from the circumscribed mandrel. Thus, this structure tends to sustain rubber attachment to not only the mandrel or alternative cylindrical downhole member, but also the intervening webbing layers, thereby resulting in a swellable packer having astounding swelling characteristics heretofore believed to be unattainable in the art. As an example of such plurality of webbing lawyers, fortified embodiments may be configured with ½ inch increments, wherein assuming a mandrel having 4 inch outer diameter, the innermost rubber member layer would have 4½ inch outside diameter, the next webbing layer member would have a corresponding 5 inch outside diameter, the next outer rubber member would have a 5½ inch outside diameter, and the outer next outer webbing member layer would have a 6 inch outside diameter. Thus, there would be intermittent concentric layers of elastomeric members and webbing members comprising this novel fortified packer structure designed to assure maximum swelling characteristics.

Another feature of this fortified swellable packer embodiment is that the webbing member prevents the elastomeric element from swelling excessively. Normally, as will be understood by those skilled in the art, if an elastomeric element were to swell excessively, it is apt to deteriorate. But, for the webbing-fortified embodiment, the webbing member tends to bond with the elastomeric element and to stretch proportionately with the bonded elastomeric element. It will be seen that the elastomeric element remains attached to the webbing member and remains in situ therewith so that deterioration thereof tends to be precluded. As an example, if a fortified packer were configured with a 5 inch diameter within a 5½ inch inside diameter borehole, then expansion would be limited. On the other hand, if a fortified packer were configured with a 5 inch diameter within a 9 inch inside diameter borehole, then expansion would need to accommodate much larger expansion to avoid bond failure with a consequence of loss of swellable packer integrity causing failure thereof.

It will, of course, be readily appreciated that akin to any similarly situated packer, any of the swellable packer embodiments of the present invention are limited by irreversible swelling of the elastomeric element thereof.

It has been found that the outside diameter of swellable packers as contemplated hereunder are significantly smaller than industry standard packer outside diameters, while nevertheless affording comparable seal capabilities. Alternatively, and equally impressive, if embodiments hereof are characterized by essentially the same outside diameter as industry standard packers, then significantly increased swelling of the rubber seal is manifest which obviously produces superior seals to what has heretofore been achievable in the frac art.

Moreover, since swellable packer embodiments of the present invention inherently enjoy smaller outside diameters than the prior art, there is much less probability of these packers causing blockage or sticking or otherwise interfering with downhole frac activity and the like.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. A swellable packer for encompassing a cylindrical downhole member having an external surface and a longitudinal axis, said swellable packer comprising:

a swellable elastomeric member having an external surface and disposed axially of said cylindrical downhole member and frictionally bonded circumferentially thereto;

said swellable elastomeric member selected to activate swelling thereof by continuously contacting a hydrocarbon fluid or an aqueous fluid from a wellbore and comprising a plurality of channels disposed circumferentially of said longitudinal axis of said cylindrical downhole member and immediately below said external surface of said swellable elastomeric member and therewithin for passage and containment of said hydrocarbon fluid or said aqueous fluid from said wellbore directly thereinto, for said continuously contacting said swellable elastomeric member with said hydrocarbon fluid or said aqueous fluid and thereby activating swelling thereof;

said plurality of channels comprising a first plurality of channels disposed longitudinally from one end portion of said cylindrical downhole member to a middle portion thereof and disposed proximal to the external surface of said swellable elastomeric member, and a second plurality of channels disposed longitudinally from the other opposite end portion of said cylindrical downhole member to said middle portion thereof and disposed proximal to the external surface of said swellable elastomeric member, with said hydrocarbon fluid or said aqueous fluid entering each of said first plurality of channels and said second plurality of channels said directly from said wellbore; and each of said first plurality of channels being offset from said second plurality of channels so that there is no fluid communication therebetween.

2. The swellable packer recited in claim 1, wherein the external surface of said cylindrical downhole member is preferably roughened by sand blasting prior to being configured with said swellable elastomeric member disposed circumferentially thereupon.

3. The swellable packer recited in claim 2, wherein a first solid metal ring and a second solid metal ring, each having concentric channels therein, are disposed at respective opposite ends of said cylindrical downhole member circumscribed by said swellable elastomeric member and frictionally attached to the external surface thereof.

4. The swellable packer recited in claim 3, wherein said activated swelled swellable rubber member is confined axially by said first solid metal ring at one end thereof and by said second solid metal ring at the other opposite end thereof.

5. The swellable packer recited in claim 3, wherein said plurality of channels comprises a plurality of radial channels with each radial channel thereof penetrating radially into said swellable elastomeric member from said external surface to a corresponding interior interface thereof with said cylindrical downhole member disposed throughout the longitudinal axis thereof.

6. The swellable packer recited in claim 5, wherein each said channel of said plurality of radial channels has a fixed diameter in the range 0.08 inches to 0.20 inches.

7. The swellable packer recited in claim 5, wherein each said channel of said plurality of radial channels has a fixed diameter of 0.098 inches.

8. The swellable packer recited in claim 1, wherein a first metal ring and a second metal ring are disposed at respective opposite ends of said cylindrical downhole member circumscribed by said swellable elastomeric member and frictionally attached to the external surface thereof.

9. The swellable packer recited in claim 8, wherein said activated swelled swellable elastomeric member is confined axially by said first metal ring at one end thereof and by said second metal ring at the other opposite end thereof.

10. The swellable packer recited in claim 1, wherein said offset of said first plurality of channels is offset from said second plurality of channels by a range of 5° to 40°.

11. The swellable packer recited in claim 1, wherein said offset of said first plurality of channels is offset from said second plurality of channels by a range of 15° to 35°.

12. The swellable packer recited in claim 1, wherein said offset of said first plurality of channels is offset from said second plurality of channels by a range of 20° to 25°.

13. The swellable packer recited in claim 1, wherein said offset of said first plurality of channels is offset from said second plurality of channels by a 22½°.

14. The swellable packer recited in claim 1, wherein each said channel of said plurality of channels has a fixed diameter in the range 0.06 inches to 0.16 inches.

15. The swellable packer recited in claim 1, wherein each said channel of said plurality of channels has a fixed diameter of 0.078 inches.

16. The swellable packer recited in claim 1, wherein each said channel of said plurality of channels has a variable diameter in the range 0.06 inches to 0.16 inches.

17. A swellable packer encompassing a cylindrical downhole member having an external surface and a longitudinal axis, said swellable packer comprising:

a swellable fortified elastomeric member having an external surface and disposed axially of said cylindrical downhole member with a first inner elastomeric layer thereof frictionally bonded circumferentially thereto, and having an elastic webbing member disposed annularly of said first inner elastomeric layer and a second outer elastomeric layer and bonded thereto;

said elastic webbing member tightly wound circumferentially of said first inner elastomeric layer;

said swellable layered elastomeric member selected to activate swelling thereof by continuously contacting a hydrocarbon fluid or an aqueous fluid from a wellbore and further comprising a plurality of channels disposed longitudinally and radially of said longitudinal axis of said cylindrical downhole member, immediately below said external surface of said swellable fortified elastomeric member and therewithin for passage and containment of at least one of a hydrocarbon fluid or an aqueous fluid from a wellbore directly thereinto, for contacting said swellable layered elastomeric member with said hydrocarbon fluid or said aqueous fluid and thereby activating expansion swelling thereof; and each of said first plurality of longitudinal channels being offset from said second plurality of longitudinal channels so that there is no fluid communication therebetween.

* * * * *